US007374550B2

(12) United States Patent
Hansen et al.

(10) Patent No.: US 7,374,550 B2
(45) **Date of Patent: *May 20, 2008**

(54) RESPIRATORY VEST FOR REPETITIVE PRESSURE PULSES

(75) Inventors: Craig N. Hansen, Plymouth, MN (US); Lonnie J. Helgeson, New Prague, MN (US)

(73) Assignee: Electromed, Inc., New Prague, MN (US)

( * ) Notice: Subject to any disclaimer, the term of this patent is extended or adjusted under 35 U.S.C. 154(b) by 423 days.

This patent is subject to a terminal disclaimer.

(21) Appl. No.: 11/100,778

(22) Filed: Apr. 7, 2005

(65) Prior Publication Data

US 2005/0234372 A1 Oct. 20, 2005

Related U.S. Application Data

(63) Continuation-in-part of application No. 10/646,357, filed on Aug. 22, 2003, now Pat. No. 7,278,978, which is a continuation-in-part of application No. 09/902,471, filed on Jul. 10, 2001, now Pat. No. 6,676,614.

(60) Provisional application No. 60/217,367, filed on Jul. 11, 2000.

(51) Int. Cl.
*A61H 31/00* (2006.01)

(52) U.S. Cl. ..... 601/152; 601/DIG. 11

(58) Field of Classification Search ..... 601/41, 601/44, 148–152; 128/DIG. 20; 602/13
See application file for complete search history.

(56) References Cited

U.S. PATENT DOCUMENTS

| | | | | |
|---|---|---|---|---|
| 4,120,297 | A * | 10/1978 | Rabischong et al. | 602/19 |
| 4,135,503 | A * | 1/1979 | Romano | 602/13 |
| 4,375,217 | A * | 3/1983 | Arkans | 601/152 |
| 4,402,312 | A * | 9/1983 | Villari et al. | 601/152 |
| 5,938,627 | A * | 8/1999 | Hickman | 601/149 |
| 6,036,662 | A * | 3/2000 | Van Brunt et al. | 601/41 |
| 6,254,556 | B1 | 7/2001 | Hansen et al. | |
| D461,897 | S | 8/2002 | Hansen et al. | |
| 6,488,641 | B2 | 12/2002 | Hansen | |
| 6,547,749 | B2 | 4/2003 | Hansen | |
| 6,605,050 | B2 | 8/2003 | Hansen | |
| 6,676,614 | B1 | 1/2004 | Hansen et al. | |

* cited by examiner

*Primary Examiner*—Danton DeMille

(57) ABSTRACT

A vest for a human body has a bladder coupled to a pulsator operable to subject the vest to repeated pulses of air which applies and releases pressure to the body. The vest has a cover having a pocket accommodating the bladder, shoulder straps, and end flaps. The bladder is permanently connected to the cover. Releasable hook and loop fasteners connect the straps to chest portions of the vest and end flaps to each other. A releasable retainer secured to the end flaps prevent the end flaps and releasable fasteners from disengaging when air pressure pulses are applied to the vest. The bladder has an air chamber and a sleeve having an air receiving passage and openings to allow air to flow from the air receiving passage into the air chamber. An oval-shaped coil spring within the sleeve maintains the air receiving passage open.

37 Claims, 15 Drawing Sheets

RESPIRATORY VEST FOR REPETITIVE PRESSURE PULSES

CROSS REFERENCE TO RELATED APPLICATION

This application is a continuation-in-part of U.S. application Ser. No. 10/646,357 filed Aug. 22, 2003 now U.S. Pat. No. 7,278,978. Application Ser. No. 10/646,357 is a continuation-in-part of U.S. application Ser. No. 09/902,471 filed Jul. 10, 2002, now U.S. Pat. No. 6,676,614. Application Ser. No. 10/646,357 claims the priority of U.S. application Ser. No. 60/217,367 file Jul. 11, 2000.

FIELD OF THE INVENTION

The invention is directed to a medical device and method to apply repetitive compression forces to the thorax of a person to aid blood circulation, loosening and elimination of mucus from the lungs of a person and relieve muscular and nerve tensions.

BACKGROUND OF THE INVENTION

Clearance of mucus from the respiratory tract in healthy individuals is accomplished primarily by the body's normal mucociliary action and cough. Under normal conditions these mechanisms are very efficient. Impairment of the normal mucociliary transport system or hypersecretion of respiratory mucus results in an accumulation of mucus and debris in the lungs and can cause severe medical complications such as hypoxemia, hypercapnia, chronic bronchitis and pneumonia. These complications can result in a diminished quality of life or even become a cause of death. Abnormal respiratory mucus clearance is a manifestation of many medical conditions such as pertussis, cystic fibrosis, atelectasis, bronchiectasis, cavitating lung disease, vitamin A deficiency, chronic obstructive pulmonary disease, asthma, and immotile cilia syndrome. Exposure to cigarette smoke, air pollutants and viral infections also adversely affect mucociliary function. Post surgical patients, paralyzed persons, and newborns with respiratory distress syndrome also exhibit reduced mucociliary transport.

Chest physiotherapy has had a long history of clinical efficacy and is typically a part of standard medical regimens to enhance respiratory mucus transport. Chest physiotherapy can include mechanical manipulation of the chest, postural drainage with vibration, directed cough, active cycle of breathing and autogenic drainage. External manipulation of the chest and respiratory behavioral training are accepted practices as defined by the American Association for Respiratory Care Guidelines, 1991. The various methods of chest physiotherapy to enhance mucus clearance are frequently combined for optimal efficacy and are prescriptively individualized for each patient by the attending physician.

Cystic fibrosis (CF) is the most common inherited life-threatening genetic disease among Caucasians. The genetic defect disrupts chloride transfer in and out of cells, causing the normal mucus from the exocrine glands to become very thick and sticky, eventually blocking ducts of the glands in the pancreas, lungs and liver. Disruption of the pancreatic glands prevents secretion of important digestive enzymes and causes intestinal problems that can lead to malnutrition. In addition, the thick mucus accumulates in the lung's respiratory tracts, causing chronic infections, scarring, and decreased vital capacity. Normal coughing is not sufficient to dislodge these mucus deposits. CF usually appears during the first 10 years of life, often in infancy. Until recently, children with CF were not expected to live into their teens. However, with advances in digestive enzyme supplementation, anti-inflammatory therapy, chest physical therapy, and antibiotics, the median life expectancy has increased to 30 years with some patients living into their 50's and beyond. CF is inherited through a recessive gene, meaning that if both parents carry the gene, there is a 25 percent chance that an offspring will have the disease, a 50 percent chance they will be a carrier and a 25 percent chance they will be genetically unaffected. Some individuals who inherit mutated genes from both parents do not develop the disease. The normal progression of CF includes gastrointestinal problems, failure to thrive, repeated and multiple lung infections, and death due to respiratory insufficiency. While some patients experience grave gastrointestinal symptoms, the majority of CF patients (90 percent) ultimately succumb to respiratory problems.

A demanding daily regimen is required to maintain the CF patient's health, even when the patient is not experiencing acute problems. A CF patient's CF daily treatments may include:

- Respiratory therapy to loosen and mobilize mucus;
- Inhalation therapy with anti-inflammatory drugs, bronchodilators and antibiotics for infections;
- Oral and intravenous antibiotics to control infection;
- Doses of Pulmozyme to thin respiratory mucus;
- 20 to 30 pancreatic enzyme pills taken with every meal to aid digestion;
- a low-fat, high-protein diet;
- Vitamins and nutritional supplements; and
- Exercise.

A lung transplant may be the only hope for patients with end stage cystic fibrosis.

Virtually all patients with CF require respiratory therapy as a daily part of their care regimen. The buildup of thick, sticky mucus in the lungs clogs airways and traps bacteria, providing an ideal environment for respiratory infections and chronic inflammation. This inflammation causes permanent scarring of the lung tissue, reducing the capacity of the lungs to absorb oxygen and, ultimately, sustain life. Respiratory therapy must be performed, even when the patient is feeling well, to prevent infections and maintain vital capacity. Traditionally, care providers perform Chest Physical Therapy (CPT) one to four times per day. CPT consists of a patient lying in one of twelve positions while a caregiver "claps" or pounds on the chest and back over each lobe of the lung. To treat all areas of the lung in all twelve positions requires pounding for half to three-quarters of an hour along with inhalation therapy. CPT clears the mucus by shaking loose airway secretions through chest percussions and draining the loosened mucus toward the mouth. Active coughing is required to ultimately remove the loosened mucus. CPT requires the assistance of a caregiver, often a family member but a nurse or respiratory therapist if one is not available. It is a physically exhausting process for both the CF patient and the caregiver. Patient and caregiver non-compliance with prescribed protocols is a well-recognized problem that renders this method ineffective. CPT effectiveness is also highly technique sensitive and degrades as the giver becomes tired. The requirement that a second person be available to perform the therapy severely limits the independence of the CF patient.

Artificial respiration devices for applying and relieving pressure on the chest of a person have been used to assist in lung breathing functions, and loosening and eliminating mucus from the lungs of CF persons. Subjecting the person's chest and lungs to pressure pulses or vibrations decreases the viscosity of lung and air passage mucus, thereby enhancing fluid mobility and removal from the lungs. These devices use vests having air-accommodating bladders that surround the chests of persons. Mechanical mechanisms, such as solenoid or motor-operated air valves, bellows and pistons are disclosed in the prior art to supply air under pressure to diaphragms and bladders in regular pattern or pulses. The bladder worn around the thorax of the CF person repeatedly compresses and releases the thorax at frequencies as high as 25 cycles per second. Each compression produces a rush of air through the lobes of the lungs that shears the secretions from the sides of the airways and propels them toward the mouth where they can be removed by normal coughing. External chest manipulation with high frequency chest wall oscillation was reported in 1966. *Beck G J. Chronic Bronchial Asthma and Emphysema. Rehabilitation and Use of Thoracic Vibrocompression, Geriatrics* (1966), 21: 139-158.

G. A. Williams in U.S. Pat. No. 1,898,652 discloses an air pulsator for stimulating blood circulation and treatment of tissues and muscles beneath the skin. A reciprocating piston is used to generate air pressure pulses which are transferred through a hose to an applicator having a flexible diaphragm. The pulsating air generated by the moving piston imparts relatively rapid movement to the diaphragm which subjects the person's body to pulsing forces.

J. D. Ackerman et al in U.S. Pat. No. 2,588,192 disclose an artificial respiration apparatus having a chest vest supplied with air under pressure with an air pump. Solenoid-operated valves control the flow of air into and out of the vest in a controlled manner to pulsate the vest, thereby subjecting the person's chest to repeated pressure pulses.

R. F. Gray in U.S. Pat. No. 3,078,842 discloses a bladder for cyclically applying an external pressure to the chest of a person. A pressure alternator applies air pressure to the bladder. A pulse generator applies air pressure to the bladder to apply pressure pulses to the chest of the person.

R. S. Dillion in U.S. Pat. No. 4,590,925 uses an inflatable enclosure to cover a portion of a person's extremity, such as an arm or leg. The enclosure is connected to a fluid control and pulse monitor operable to selectively apply and remove pressure on the person's extremity.

W. J. Warwick and L. G. Hansen in U.S. Pat. Nos. 4,838,263 and 5,056,505 disclose a chest compression apparatus having a chest vest surrounding a person's chest. A motor-driven rotary valve allows air to flow into the vest and vent air therefrom to apply pressurized pulses to the person's chest. An alternative pulse pumping system has a pair of bellows connected to a crankshaft with rods operated with a dc electric motor. The speed of the motor is regulated with a controller to control the frequency of the pressure pulses applied to the vest. The patient controls the pressure of the air in the vest by opening and closing the end of an air vent tube.

C. N. Hansen in U.S. Pat. Nos. 5,453,081 and 5,569,170 discloses an air pulsating apparatus for supplying pulses of air to an enclosed receiver, such as a vest located around a person's chest. The apparatus has a casing with an internal chamber containing a diaphragm. An electric operated device connected to the diaphragm is operated with a pulse generator to vibrate the diaphragm to pulse the air in the chamber. A hose connects the chamber with the vest to transfer air and air pulses to the vest which applies pressure pulses to the person's chest.

N. P. Van Brunt and D. J. Gagne in U.S. Pat. Nos. 5,769,797 and 6,036,662 disclose an oscillatory chest compression device having a wall with an air chamber and a diaphragm mounted on the wall and exposed to the air chamber. A rod pivotally connected to the diaphragm and rotatably connected to a crankshaft transmits force to the diaphragm during rotation of the crankshaft. An electric motor drives the crankshaft at selected controlled speeds to regulate the frequency of the air pulses generated by the moving diaphragm. An air flow generator, shown as a blower, delivers air to the air chamber to maintain the pressure of the air in the chamber. Controls for the motors that move the diaphragm and rotate the blower are responsive to the air pressure pulses and pressure of the air in the air chamber. These controls have air pressure responsive feedback systems that regulate the operating speeds of the motors to control the pulse frequency and air pressure in the vest.

C. N. Hansen and G. E. McNamara disclose in U.S. Pat. Nos. 6,254,556 and 6,605,050 a vest used to apply repetitive pressure pulses to the front, sides and back of the thorax of a person. The vest has a cover with a pocket accommodating an air core. The air core has a plurality of upright air chambers and a bottom manifold passage connected to an air pressure pulsator. Air introduced into the manifold passage flows through a central back opening in the air core into the chambers thereby apply air pressure and pressure pulses to both the front, sides, and back of the chest of the person wearing the vest.

SUMMARY OF THE INVENTION

The invention comprises a vest used to apply pressure and repetitive pressure pulses to the upper body or thorax of a person. The vest can be used by persons in prone positions, such as a person confined to a bed or a generally horizontal support. The vest has a one-piece outer jacket or cover comprising a flexible non-elastic sheet member or fabric. The cover has a front panel, a back panel, and shoulder members joining the front and back panels. The middle of the cover has a generally circular opening of a size to slip over a person's head to locate the vest around the person's thorax. Releasable fasteners connect the front and back panels to retain the vest around the person's thorax. A bladder having an internal air chamber is secured to the inside surface of the cover. The bladder has a flexible outside wall adapted to be located adjacent the thorax of the person wearing the vest. The flexible wall can be in surface contact with the outer skin of the front of the person's thorax. The bottom portion of the bladder has a sleeve with an elongated air passage accommodating a flexible open member that allows air to flow in the air passage and into the air chamber. The bottom portion of the bladder is connected with a flexible hose to an air pulsator operable to generate air pressure and air pressure pulses which are transmitted to the air chamber of the bladder. The pressure forces and pressure pulses subjected to the bladder transmit repetitive pressure pulses to the front of the thorax of the person wearing the vest to enhance airway clearance and lung functions.

The vest cover has side flaps on the opposite sides of the back panel. A plurality of loop pads secured to the flaps cooperate with hook pads attached to opposite sides of the front panel to retain the vest around the thorax of a person. The loop and hook pads are VELCRO fasteners that releasably connect the front and rear panels and retain the vest in an adjusted position relative to the thorax of a person. The loop and hook pads permit circumferential adjustment of the vest to fit the girth of the thorax of the person. The bladder has an inside wall secured to the inside surface of the front panel and a flexible outside wall. The inside and outside walls surround an air chamber. The outside wall has a plurality of small holes that allow air to ventilate from the air chamber and deflate the bladder. Horizontal divider seals connecting the inner and outer walls of the bladder separate an air passage from the air chamber. The horizontal divide seals are spaced from each other providing a plurality of openings to allow air to flow from the air passage into the air chamber. Spacers, shown as loop pads, located through the openings between the seals ensure upward air flow from the air passage into the air chamber. The pulsing of air in the air chamber applies inward and upward pressure pulses to the front of the thorax of the person to facilitate airway clearance of secretions and lung functions. The open member is a flexible circular coil spring located in the air passage that maintains the air passage open to allow air to flow along the length of the air passage. An alternative coil spring has an oval shape. The coil spring and non-elastic cover extended around the air passage limits inward pressure of the lower front end of the vest on the abdomen of the person. The coil spring is attached to a tubular clamp which extends through openings in the lower end of the bladder and cover. The clamp has an open end to allow the air pulsator to be connected to the clamp with an elongated hose to supply air pressure and air pressure pulses to the air in the air passage and air chamber of the bladder. The coil spring extends transversely along the bottom of the vest. In one embodiment of the vest the back panel is flat and flexible and does not inhibit a person wearing the vest from lying on a bed or support. The comfort of a supine person is not compromised.

A modification of the vest has the bladder permanently connected to the cover whereby the bladder is not removable from the cover. The cover does not include a zipper or other closing devices allowing access to the interior space or pocket of the bladder. The vest is a low-cost and single patient or user item. The vest is disposable after the single patient use.

DESCRIPTION OF PREFERRED EMBODIMENT

Figure 1:
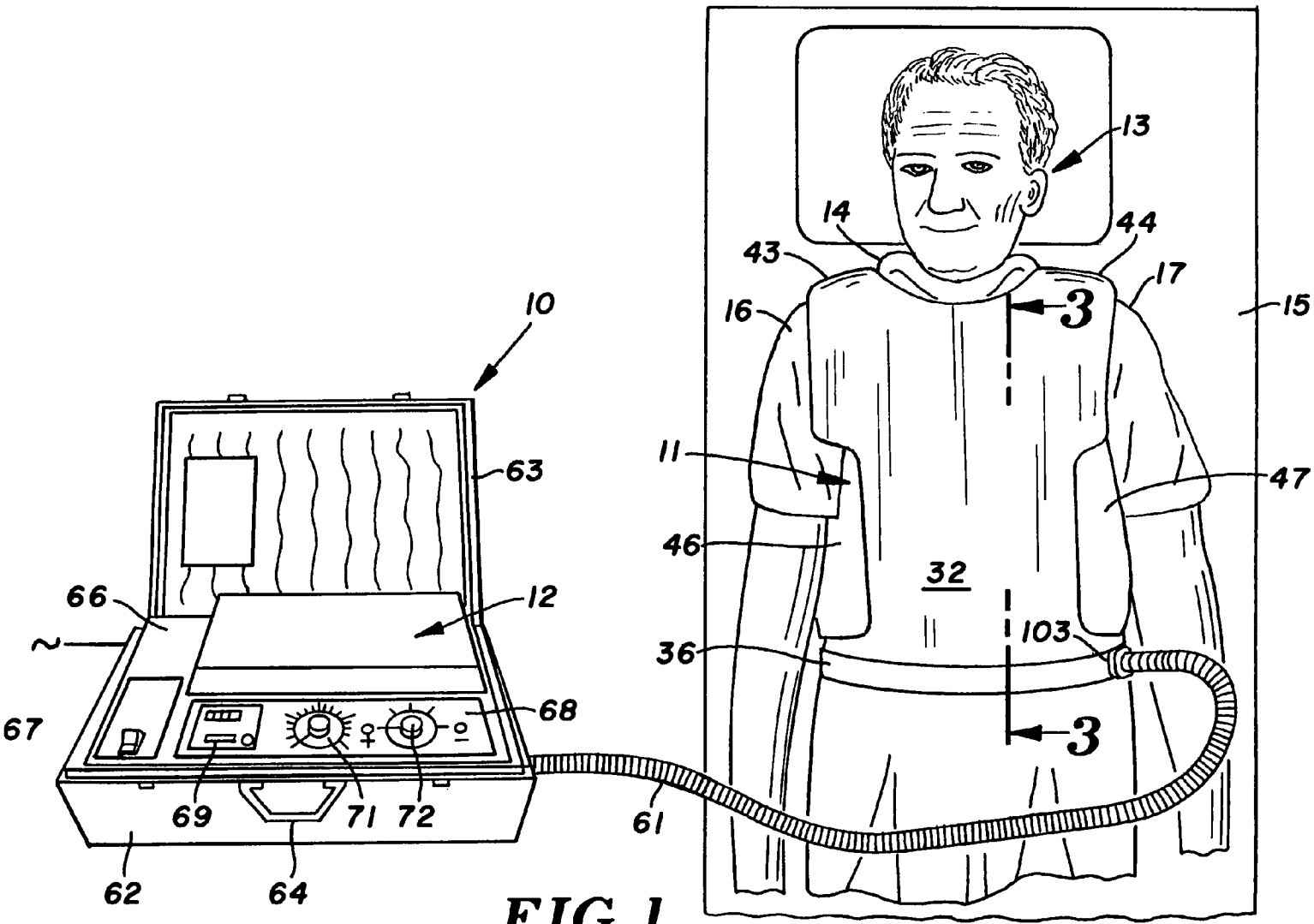
FIG. 1 is a front elevational view of the respiratory vest located on a supine person and connected to an air pulsator.

A human body pulsating apparatus, indicated generally at 10 in FIG. 1, includes a respiratory vest 11 and an air pressure and air pulse generator 12, known as a pulsator. Pulsating apparatus 10 is used to apply repetitive pressure pulses to the front of a person's thorax to enhance respiratory functions and provide secretion and mucus clearance therapy. An elongated flexible hose or tube 61 connecting vest 11 to generator 12 transfers air pressure and air pressure pulses from generator 12 to vest 11. An example of generator 12 is disclosed in U.S. Pat. No. 6,547,749 incorporated herein by reference. Other types of air pressure and pulse generators can be used to supply air pressure and pressure pulses to vest 11. Examples of air pressure and air pulse generators are disclosed in U.S. Pat. Nos. 1,898,652; 2,588,192; 2,918,917; 3,078,842; 4,838,263; 5,569,170 and 6,036,662.

As shown in FIG. 1, air pressure and pulse generator 12 is mounted in a case 62 having an open top and a cover 63 hinged to case 62 operable to close case 62. A handle 64 pivotally mounted on case 62 is used as a hand grip to facilitate transport of generator 12. Case 62 and cover 63 have overall dimensions that allow the case to be an aircraft carryon item.

Air pressure and pulse generator 12 has a top member 66 mounted on case 62 enclosing the operating elements of generator 12. Top member 66 is not readily removable from case 62 to prohibit unauthorized adjustments and repairs of the operating components of the air pressure and pulse generator 12. Top member 66 supports a main electric power switch 67 and a front panel 68 having an operating timer 69, a pulse frequency control knob 71 and an air pressure control knob 73. Knobs 71 and 72 are manually rotated to adjust the frequency of the air pressure pulses and the air pressure in vest 11. Frequency control knob 71 and regulates a motor controller which controls the air pulse frequency from 5 to 25 cycles per second. The adjustment of the air pressure in vest 11 is controlled by turning knob 72. The air pressure in vest 11 is controlled between 0.1 and 1.0 psi.

Respiratory mucus clearance is applicable to many medical conditions, such as pertussis, cystic fibrosis, atelectasis, bronchiectasis, cavitating lung disease, vitamin A deficiency, chronic obstructive pulmonary disease, asthma, and immobile cilia syndrome. Post surgical patients and paralyzed persons confined to beds in prone positions with respiratory distress syndrome have reduced mucociliary transport. Apparatus 10 provides high frequency chest wall oscillations or pulses to enhance mucus clearance in a person 13 with reduced mucociliary transport who are confined to a bed or generally horizontal support 15.

Figure 3:
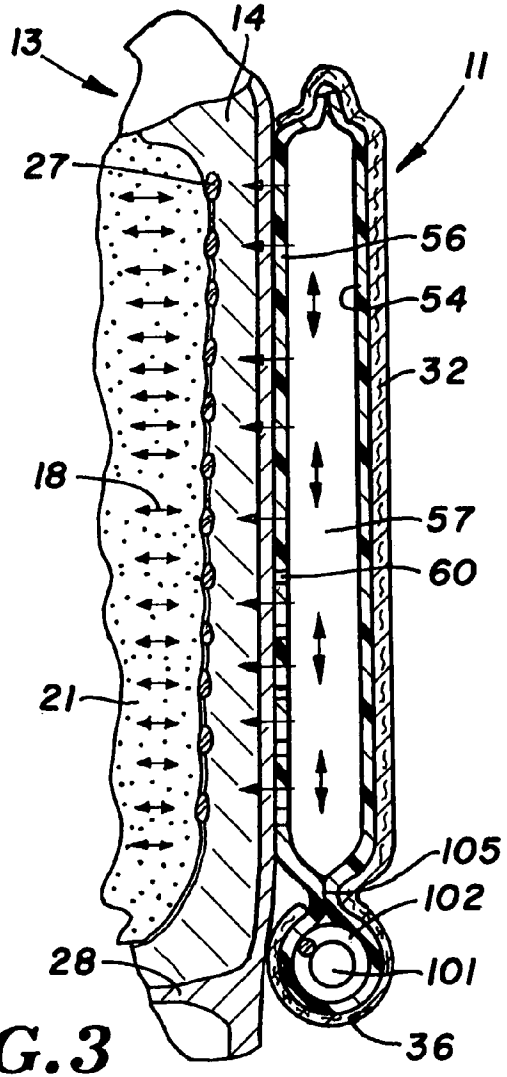
FIG. 3 is an enlarged sectional view taken along line 3-3 of FIG. 1.
Figure 2:
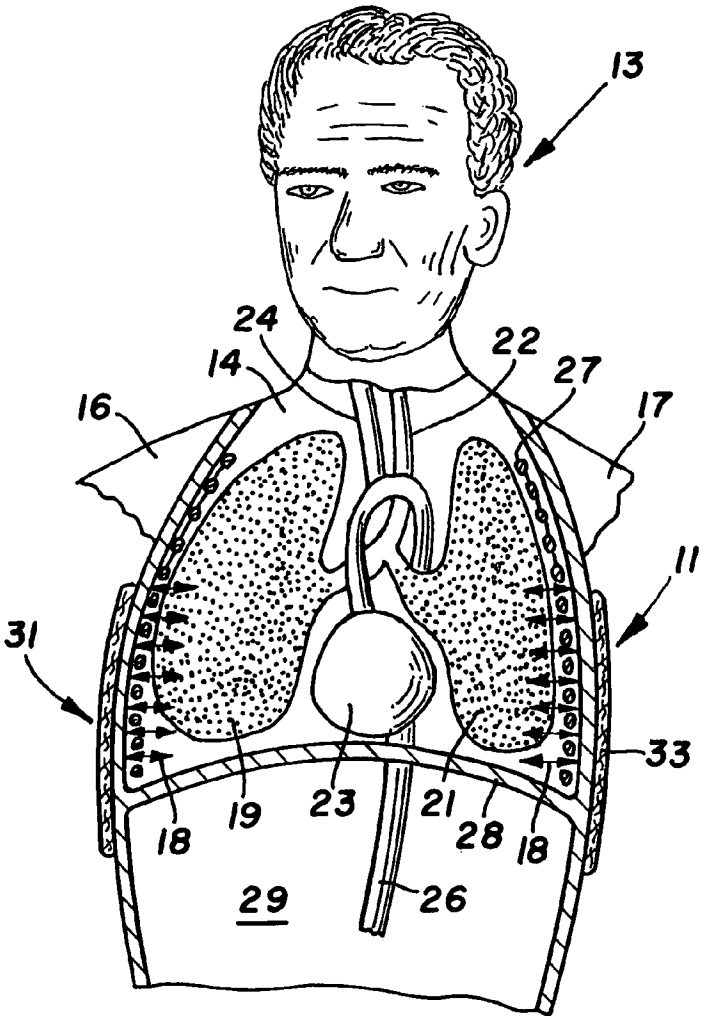
FIG. 2 is a transverse sectional view of the respiratory vest and person of FIG. 1.

Vest 11 located around the person's upper body or thorax 14 is supported on the person's shoulders 16 and 17. As shown in FIG. 3, vest 11 expanded into substantial surface contact with the exterior of the front of the thorax 14 functions to apply repeated compression or pressure pulses, shown by arrows 18 to the anterior or front portions of a person's lungs 19 and 21. The reaction of lungs 19 and 21 and trachea 22 to the pressure pulses causes repetitive expansion of the lung tissue when the pressure pulses are in the low pressure phase of the pressure cycle. The pressure pulses subjected to lungs 19 and 21 and trachea 22 provide secretions and mucus clearance therapy. The thoracic cavity occupies only the upper part of the thoracic cage and contains right and left lungs 19 and 21, heart 23, arteries 24 and 26, and rib cage 27. The repeated pressure pulses applied to thorax 14 stimulates heart 23 and blood flow in arteries 24 and 26 and veins in the chest cavity. Muscular and nerve tensions are also relieved by the repetitive pressure pulses imparted to the front portion of thorax 14. The lower part of the thoracic cage comprises the abdominal cavity 29 which reaches upward as high as the lower tip of the sternum so as to afford considerable protection to the large and easily injured abdominal organs, such as the liver, spleen, stomach, and kidneys. The two cavities are separated by a dome-shaped diaphragm 28. Rib cage 27 has twelve ribs on each side of the trunk. The ribs consist of a series of thin, curved, rather elastic bones which articulate posteriorly with the thoracic vertebrae. The spaces between successive ribs are bridged by intercostal muscles. The rib cage 29 aids in the distribution of the pressure pulses to the anterior portions of lungs 19 and 21 and trachea 22.

Figure 4:
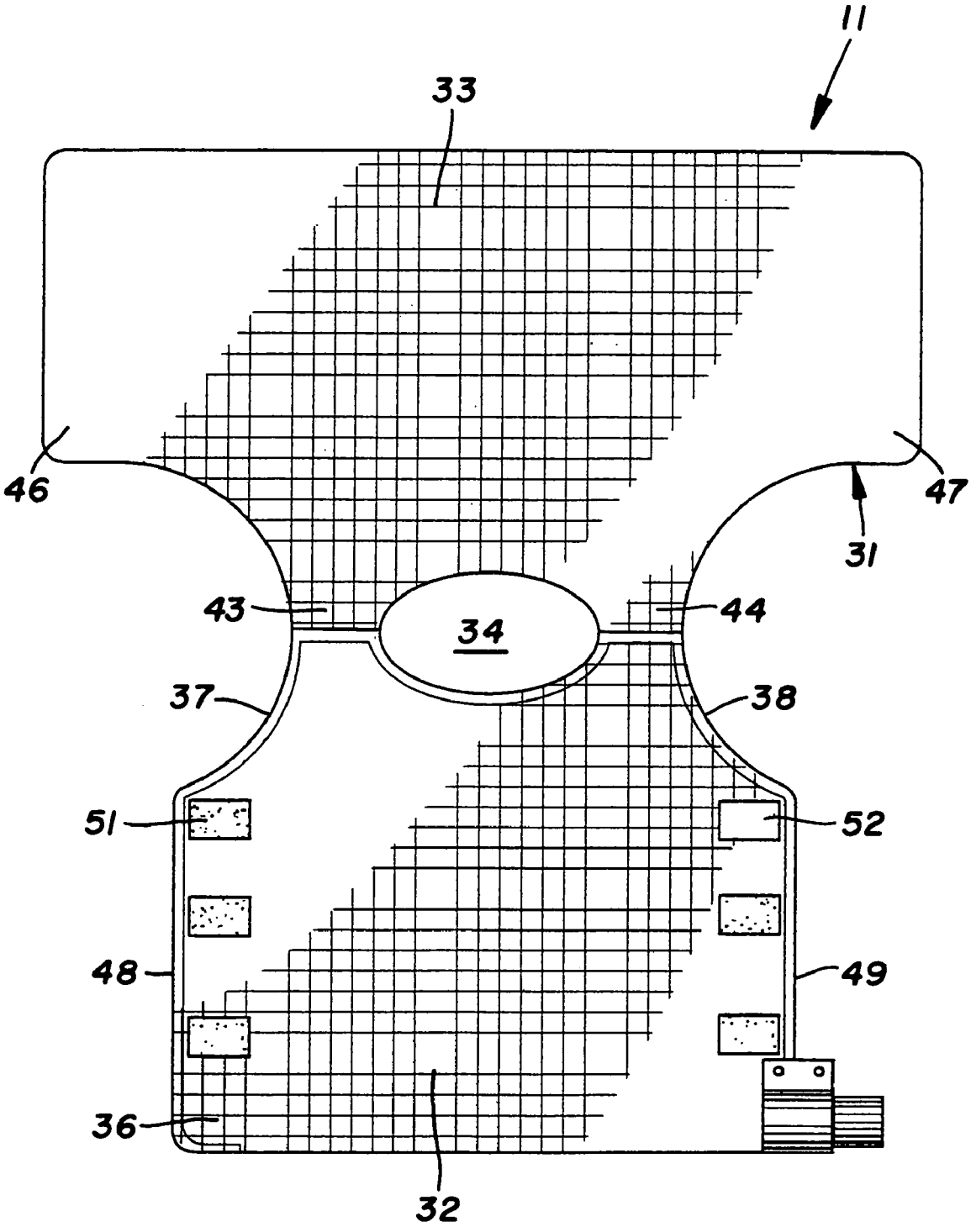
FIG. 4 is an enlarged outside front and rear plan view of the respiratory vest of FIG. 1.
Figure 5:
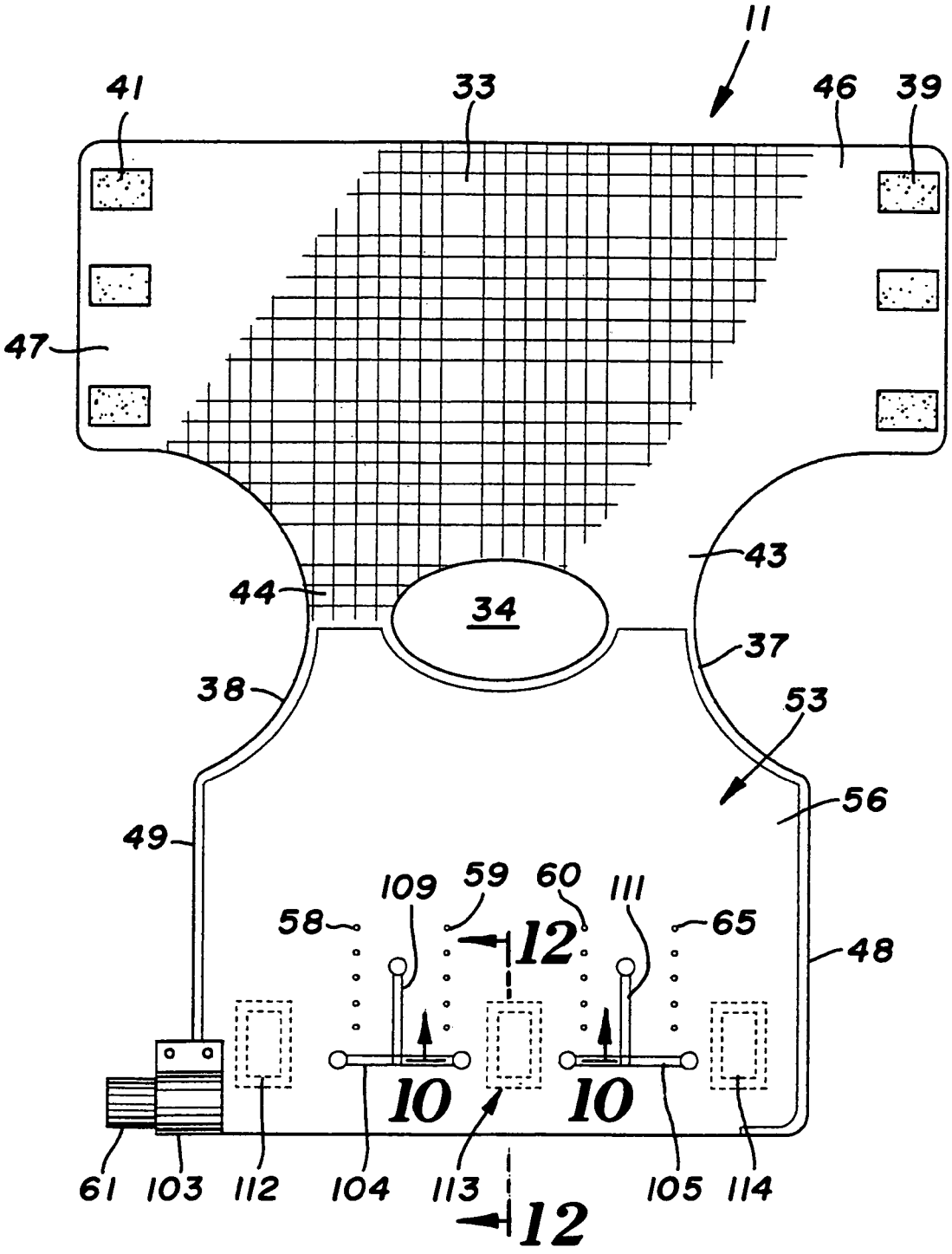
FIG. 5 is an enlarged inside front and rear plan view of the respiratory vest of FIG. 1.
Figure 6:
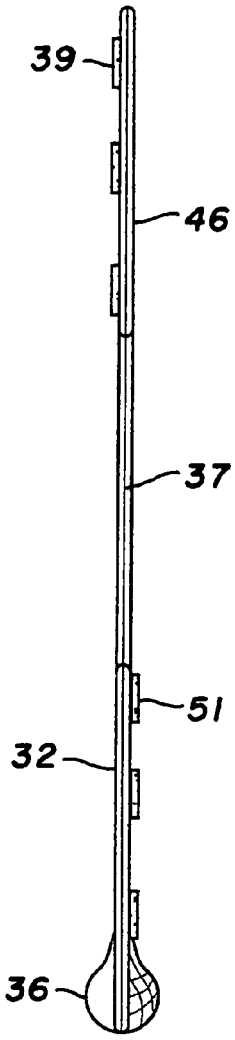
FIG. 6 is a side elevational view of the left side of the respiratory vest of FIG. 4.
Figure 7:
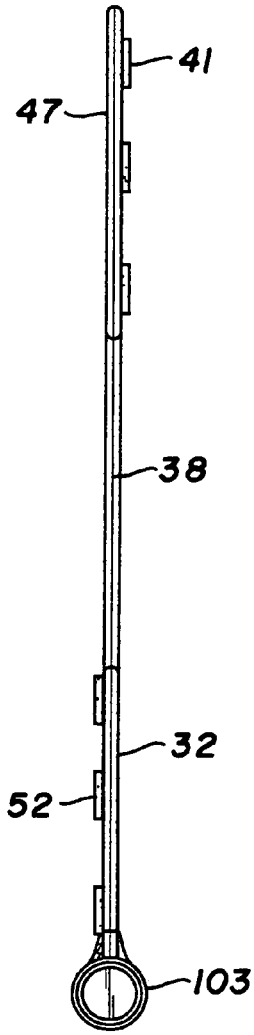
FIG. 7 is a side elevational view of the right side of the respiratory vest of FIG. 4.
Figure 8:
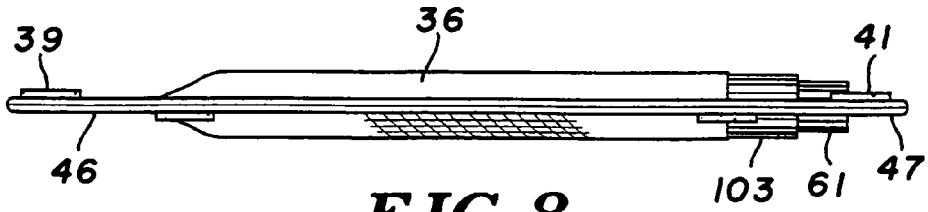
FIG. 8 is a top plan view of the left side of FIG. 4.
Figure 9:
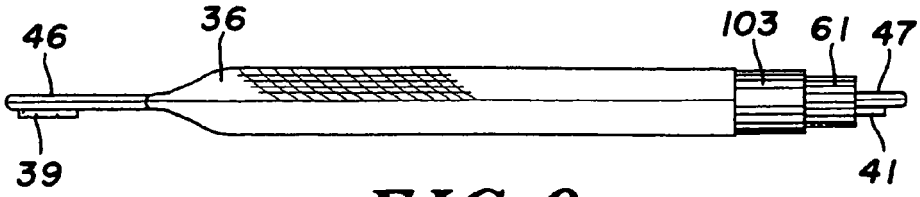
FIG. 9 is a bottom plan view of the respiratory vest of FIG. 4.

As shown in FIG. 4, vest 11 has an outside or anterior jacket or cover 31 comprising a flexible and generally non-elastic sheet, such as a nylon fabric. Other types of materials and fabrics can be used for cover 31. Cover 31 has a generally rectangular front panel 32 and a generally rectangular rear panel 33 connected to front panel 32 with shoulder portions 43 and 44. The central section of cover 31 has an opening 34 of a size to slip over the head of person 13 as shown in FIG. 1. The opposite sides of cover 31 have concave edges 37 and 38 to allow vest 11 to extend under the person's shoulder 16 and 17. As shown in FIGS. 5, 6 and 7 releasable fasteners, shown as hook-type pads 39 and 41, are secured to the outside of side flaps 46 and 47 located on opposite sides of rear panel 33. Pads 39 and 41 comprise rows of three spaced pads located adjacent the outside edges of flaps 46 and 47. Pads 39 and 41 can be loop-type pads adapted to be releasably attached to hook-type pads, known as VELCRO fasteners. Pads 39 and 41 can each be a single pad secured to flaps 46 and 47. Other types of releasable fasteners, such as releasable adhesives, can be used to attach flaps 46 and 47 to front panel 32. Front panel 32 has a transverse generally tubular bottom portion 36 and upright side edges 48 and 49. A plurality of loop-type pads 51 and 52 are secured to front panel 32 adjacent side edges 48 and 49. Pads 51 and 52 interact with pads 39 and 41 to releasably hold vest 11 about the thorax of person 13. Pads 39, 41 and 51, 52 are conventional VELCRO fasteners.

As shown in FIGS. 3, and 5, an air core or bladder, indicated generally at 53, is secured to the inside surface of front panel 32. In an alternative embodiment of the vest, the bladder is permanently connected to the cover. A bladder 53 has an outer sheet member or wall 54 joined to an inner sheet member or wall 56. An adhesive or bonding material attaches outer sheet member 54 to panel 32. An air chamber 57 is located between sheet members 54 and 56. Sheet members 54 and 56 are flexible walls of plastic or fabric having inside layers or coatings of air impervious urethane plastic. The entire flexible walls can be sheets of plastic materials. The inner sheet member 56 has a plurality of upright rows of holes 58, 59, 60 and 61 to allow air to vent or allow air to flow from chamber 57 to atmosphere. Other types of air impervious flexible sheet members can be used for bladder 53. As shown in FIG. 5, bladder 53 covers the entire inside surface of front panel 32.

Figure 10:
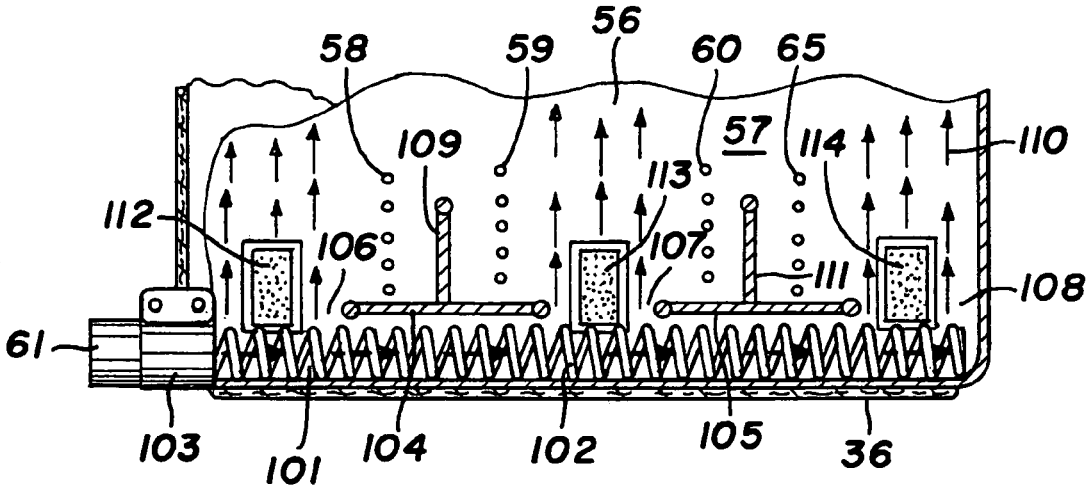
FIG. 10 is a transverse sectional view of bottom of the front of the respiratory vest of FIG. 5.
Figure 12:
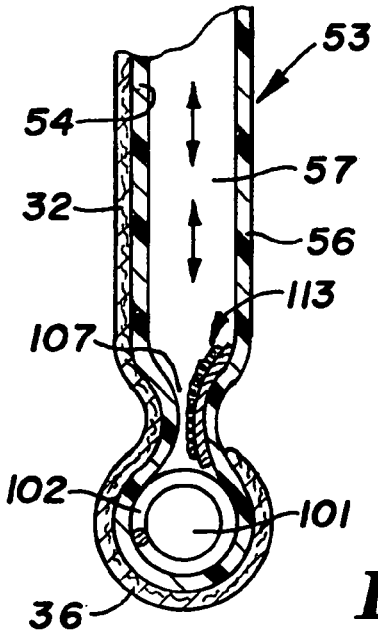
FIG. 12 is an enlarged sectional view taken along line 12-12 of FIG. 5.

As shown in FIGS. 10 and 12, the bottom portion 36 of the front panel 32 is a linear sleeve having an elongated transverse passage 101 accommodating a flexible open member shown as a coil spring 102. Spring 102 is a flexible metal coil spring that keeps passage 101 open for free flow of air and minimum interference of air pulses in passage 101. Other structures, such as an oval-shaped spring or a porous tube, in the air passage 101 can be used to provide for continuous air flow through passage 101 and into chamber 57. A tubular clamp 103 secured to the air inlet end of spring 102 accommodates the end of hose 61 to allow air from hose 61 to flow into passage 101. A pair of horizontal seals 104 and 105 joining linear sections of inner and outer sheet members 54 and 56 separate chamber 57 from passage 101 and confine coil spring 102 to passage 101. Seals 104 and 105 are spaced from each other and adjacent sides of bladder 53 to provide openings or passages 106, 107 and 108 to allow air to flow from passage 101 into chamber 57 of bladder 53. Upright seals 109 and 111 are joined to middle portions of seals 104 and 105 to direct air pulses upwardly into chamber 57. Seal 109 is parallel to and located between rows of holes 58 and 59. Seal 111 is parallel to and located between rows of holes 60 and 65. The air pulses, shown by arrows 110 in FIG. 10, directed upwardly in air chamber 37 exert upwardly and inwardly pulsed pressure forces to the front of the thorax of person 13 to enhance airway clearance of secretions and function of the lungs.

Figure 11:
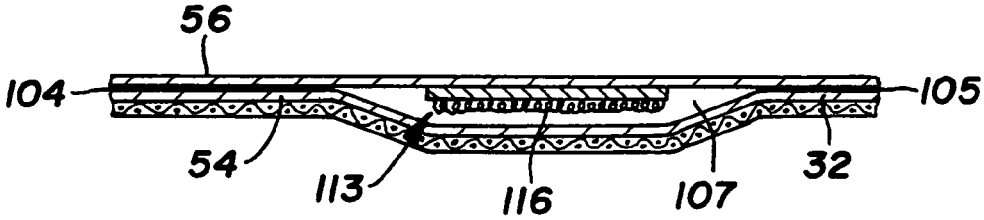
FIG. 11 is an enlarged sectional view taken along line 11-11 of FIG. 5.

As shown in FIGS. 10, 11 and 12, spacers 112, 113 and 114 extend through openings 106, 107 and 108 to maintain the passages open to ensure air flow and air pressure pulses from transverse passage 101 into air chamber 37. Spacers 112, 113 and 114 are rectangular loop pads 116 secured with an adhesive to the inside surface of inner member 56. The pads can be secured to the inside surface of outer member 54. Other types of spacers, such as short tubes, can be used to ensure air flow between passage 101 and air chamber 57.

In use, vest 11 is placed about the thorax of person 13 by pulling the vest over the person's head and locating the front panel 32 adjacent the front of the person's thorax. The rear panel 33 being a single sheet member is located adjacent the person's back. Flaps 46 and 47 are pulled over opposite side portions of front panel 32 to fit the vest around the person's thorax. Hook and loop pads 39, 52 and 41, 51 are pressed together to lock the flaps 46 and 47 to front panel 32. Flaps 46 and 47, as shown in FIG. 1, are above bottom portion 36 of vest 11 and above coil spring 102. The coil spring and non-elastic cover 31 extended around the spring and the location of the spring below flaps 46 and 47 limits inward pressure on the abdomen and organs therein and reduces stress on the digestive system. Air pulsator 12 is then connected with hose 61 to clamp 103. The operation of air pulsator 12 is started by turning switch 67 ON and setting timer 69 to the desired operating cycle. The rate of pulsation is controlled with control 71. The air flows from hose 61 into air passage 101 and openings 106, 107 and 108 upwardly into air chamber 37 of bladder 53. The pulsing of air in chamber 37 applies repetitive pressure pulses to the front of the thorax of the person's body. The operation of air pulsator 12 is described in U.S. Pat. No. 6,547,749. The air pulsator of U.S. Pat. No. 6,547,749 is incorporated herein by reference. Other types of air pressure and air pulse generators can be used to provide air pressure and air pressure pulses to vest 11.

Figure 13:
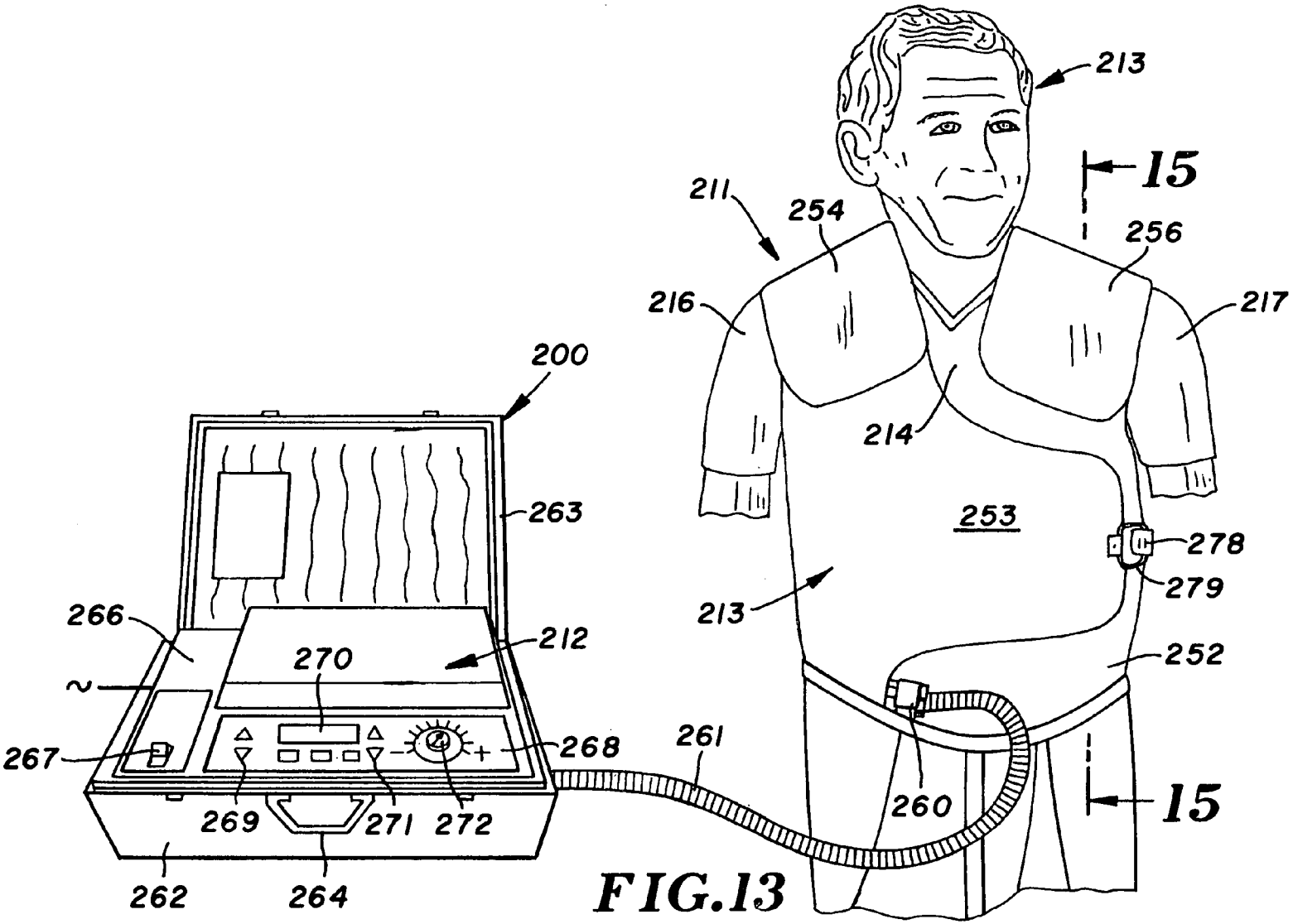
FIG. 13 is a front elevational view of a modification of the respiratory vest located around the upper body of a person connected to an air pulsator.

A modification of the pulsating apparatus 200 and respiratory vest 211 is shown in FIG. 13. The pulsating apparatus provide high frequency chest wall oscillation treatments to persons having mucocillary system disorders, neuromuscular diseases, neuromotor disorders, obstructive pulmonary conditions and restrictive airway disorders. Apparatus 200 includes a respiratory vest 211, a generator 212, known as pulsator, for creating air pressure and air pulses, and an elongated flexible hose 261 releasably connected to vest 211 and generator 212 operable to transfer air pressure and pulses from generator 212 to vest 211 to apply repetitive pressure pulses to a person's thorax to enhance respiratory functions and provide secretion and mucous clearance therapy. An example of generator 212 is disclosed in U.S. patent application Ser. No. 60/564,431, now U.S application Ser. No. 11/089,862 filed Mar. 25, 2005 incorporated herein by reference. Other types of air pressure and pulse generators are disclosed in U.S. Pat. Nos. 1,898,652; 2,588,192; 2,918,917; 3,078,842; 4,838,263; 5,056,505; 5,569,170 and 6,036,662.

Generator 212, shown in FIG. 13, is located within box-shaped case 262 having an open top. A cover or lid 263 hinged to case 262 is movable to open and closed positions. When cover 263 is closed, case 262 including the generator 212 can be manually carried with use of a handle 264. Generator 212 has a top wall 266 covering the open top of case 262 and operating elements of generator 212. A main electric power on-off switch 267 and control panel 268 are supported on top wall 266. Panel 268 includes time control keys 269, an information visual display screen 270, frequency coated keys and an air pressure manual control knob 272. Time control keys 269 are electronic switches comprising an upper + key and a lower − key to selectively program an increase or decrease of a treatment cycle between 0 to 30 minutes. The selected time period is registered on screen 270. Screen 270 is an electronic viewing display device, such as a liquid crystal display or a light-emitting organic material display. Frequency control keys 271 are electronic switches comprising an upper + key and a lower − key to selectively program an increase or decrease of the pulse frequency between 5 to 25 cycles per second or Hz. As shown in FIG. 13, time control key 269, information display screen 270, frequency control key 271 and air pressure control knob 272 are located on front panel 268 for user friendly convenience and use. The adjustment of the air pressure in air bladder 236 is controlled by manually turning knob 272. The average air pressure in air core bladder 236 is controlled between atmosphere pressure and one psi. The oscillating pressure pulses cycle above and below the selected average pressure.

Figure 15:
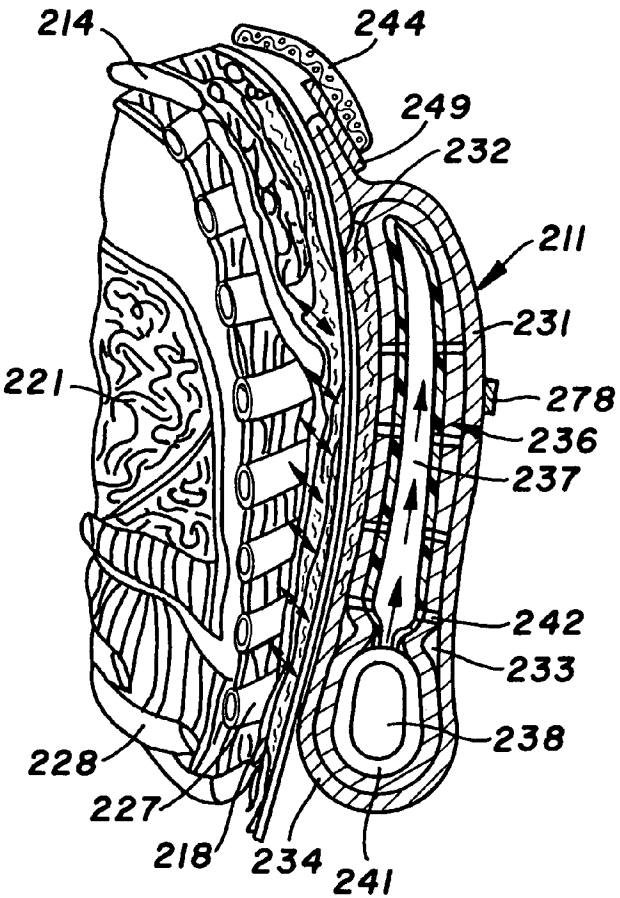
FIG. 15 is an enlarged sectional view taken along line 15-15 of FIG. 13.
Figure 14:
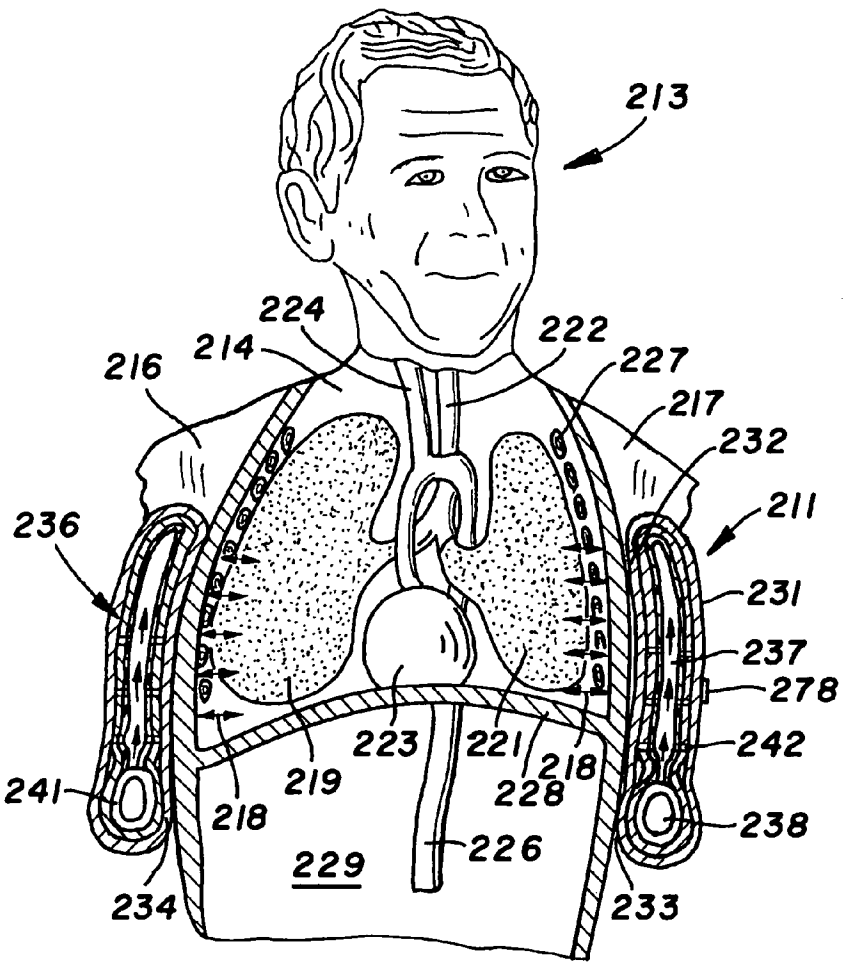
FIG. 14 is a transverse sectional view of the respiratory vest and person of FIG. 13.

Vest 211 is worn by person 213 by positioning it around the person's upper body or thorax 214 and vertically supporting it on the person's shoulders 216 and 217. As shown in FIGS. 14 and 15, vest 211 when expanded into substantial surface contact with the exterior of thorax 214 functions to apply repeated compression or pressure pulses, shown by arrows 218 to a person's lungs 219 and 221 and trachea 222. The reaction of lungs 219 and 221 and trachea 222 to the pressure pulses causes repetitive expansion of the subjected tissue when the pressure pulses are in the low pressure phase of the pressure cycle. The pressure pulses subjected to lungs 219 and 221 and trachea 222 provide secretions and mucus clearance therapy. The thoracic cavity occupies only the upper part of the thoracic cage and contains right and left lungs 219 and 221, heart 223, arteries 224 and 226, and rib cage 227. The repeated pressure pulses applied to thorax 214 stimulates heart 223 and blood flow in arteries 224 and 226 and veins in the chest cavity. Muscular and nerve tensions are also relieved by the repetitive pressure pulses imparted to the front portion of thorax 214. The lower part of the thoracic cage comprises the abdominal cavity 229 which reaches upward as high as the lower tip of the sternum so as to afford considerable protection to the large and easily injured abdominal organs, such as the liver, spleen, stomach, and kidneys. The two cavities are separated by a dome-shaped diaphragm 228. Rib cage 227 has twelve ribs on each side of the trunk. The ribs consist of a series of thin, curved, rather elastic bones which articulate posteriorly with the thoracic vertebrae. The spaces between successive ribs are bridged by intercostal muscles. The rib cage 229 aids in the distribution of the pressure pulses to the anterior portions of lungs 219 and 221 and trachea 222.

Figure 16:
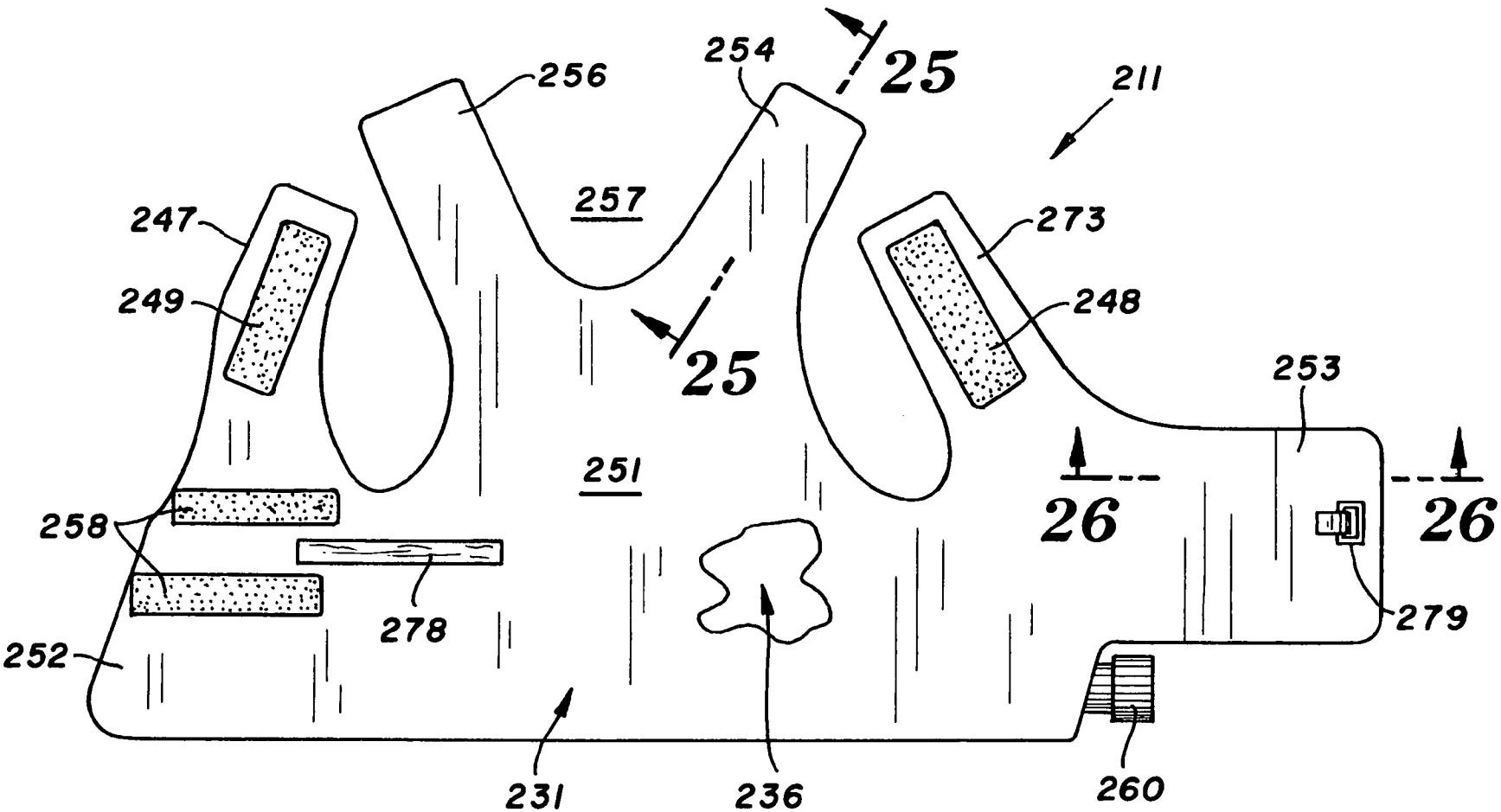
FIG. 16 is an enlarged outside front and rear plan view of the respiratory vest of FIG. 13.
Figure 17:
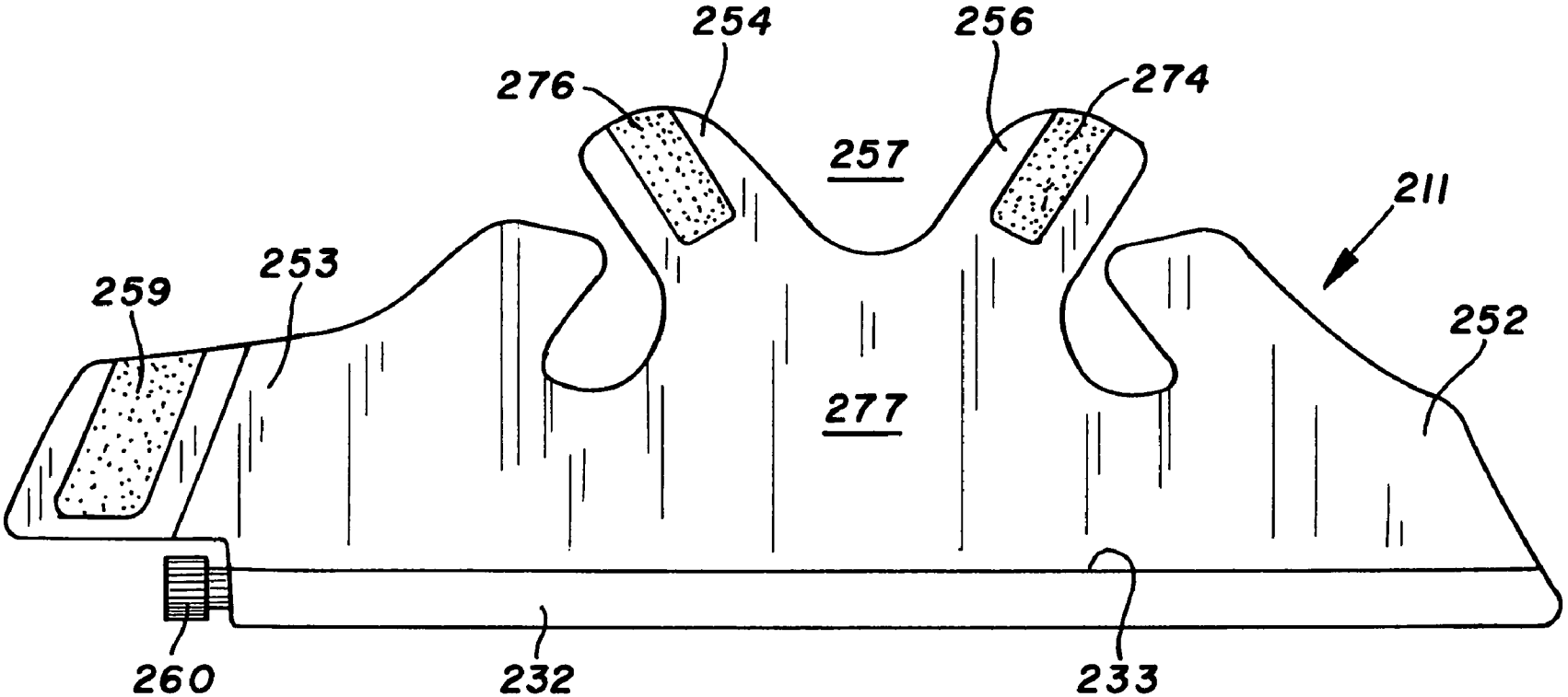
FIG. 17 is an enlarged inside front and rear plan view of the respiratory vest of FIG. 13.

As shown in FIG. 16, vest 211 has a one-piece outside or anterior jacket or cover 231 comprising a flexible and generally non-elastic sheet, such as a nylon fabric. Other types of materials and fabrics can be used for cover 231. Cover 231 has a back section 251 and front sections 252 and 253. Back section 253 is joined to shoulder straps or sections 254 and 256 that diverge outwardly on opposite sides of a neck recess or space 257 accommodating a person's neck. Front section 252 has an upwardly extended portion 247 having a releasable fastener pad 249. Front section 253 has an upwardly extended portion 273 having a releasable fastener pad 248. Vest 211 is maintained on the person's shoulders 216 and 217 by securing pad 248 to pad 274 and pad 249 to pad 276. Pads 258 and 259 attached to inside cover 277 interact to releasably retain vest 211 around the thorax of person 213. The pads are loop and hook-type pads, known as VELCRO fasteners. Other types of releasable fasteners can be used in lieu of pads 248, 249, 258, 259, 274 and 276. A retainer or strap 278 extended through a D-ring 279 provides an additional releasable fastener for holding vest 211 on person 213. Inside cover 277 is an air pervious fabric secured along its outer peripheral edges to outside cover 231. The lower longitudinal section 232 of cover 231 is turned about the bottom of an air bladder or air core 236 and linearly joined along line 233 to inside cover 277. Air bladder 236 is confined between covers 231 and 277.

Figure 18:
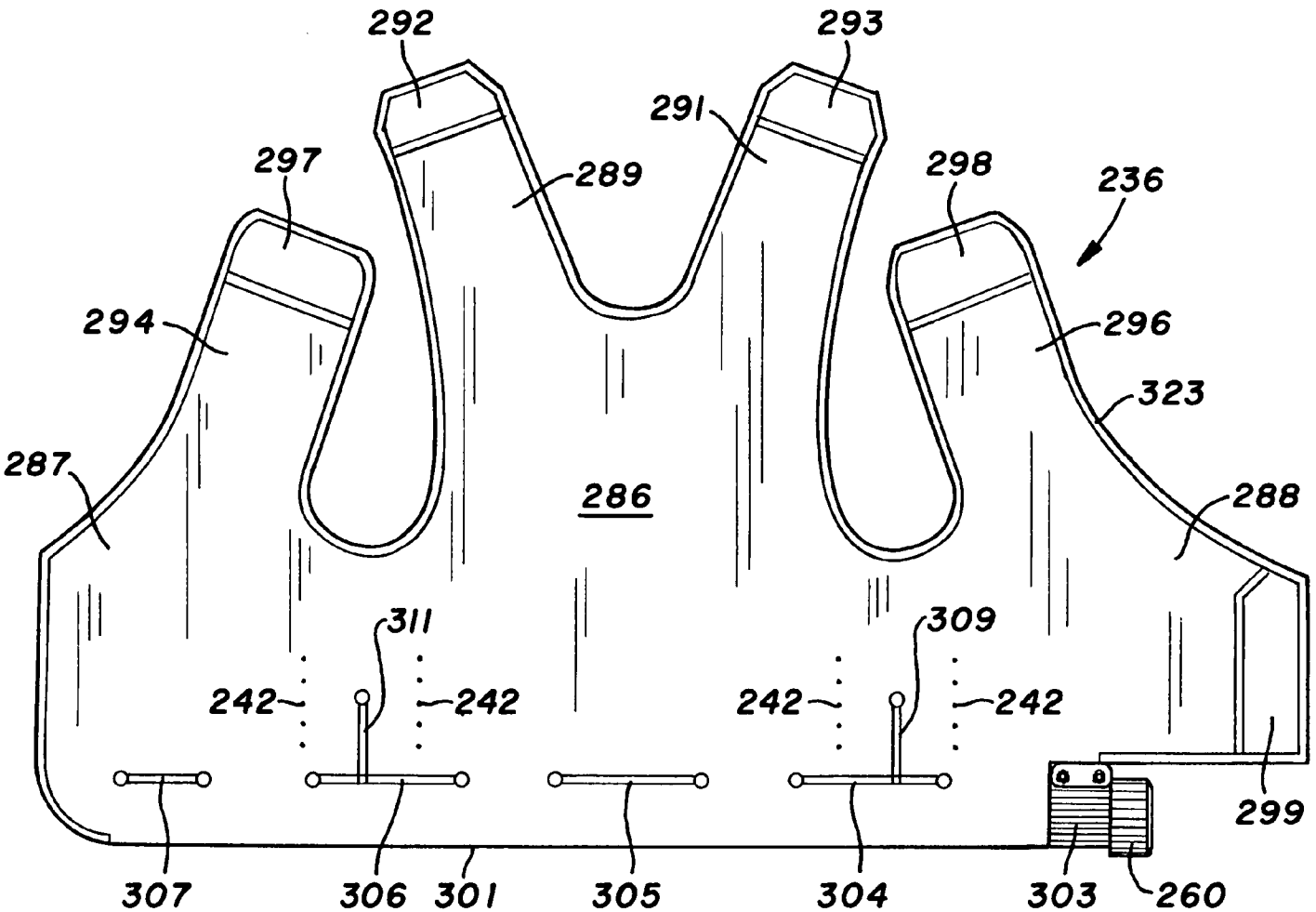
FIG. 18 is an enlarged outside front and rear plan view of the air bladder of the respiratory vest of FIG. 13.
Figure 19:
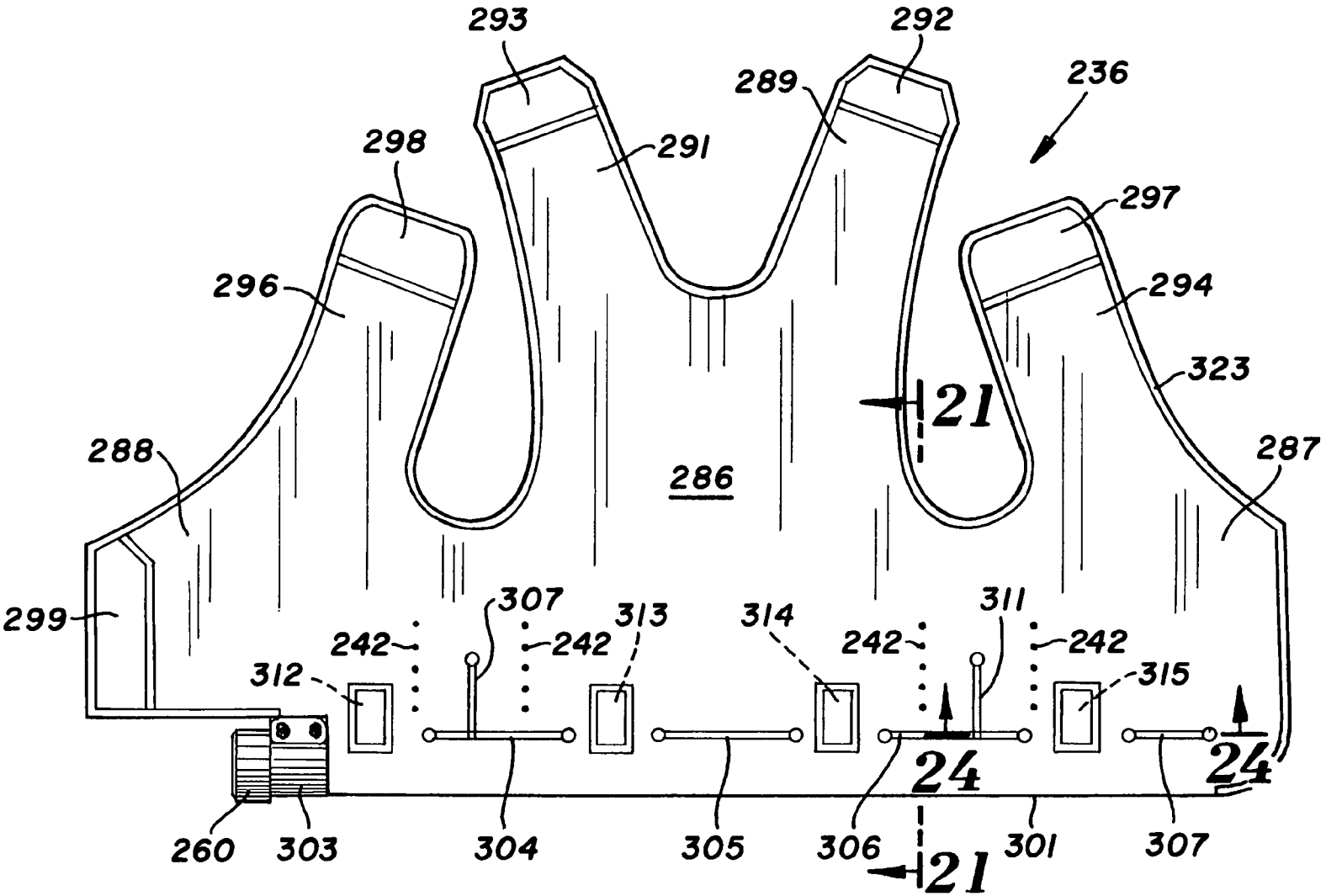
FIG. 19 is an enlarged inside front and rear plan view of the air bladder of the respiratory vest of FIG. 13;.
Figure 20:
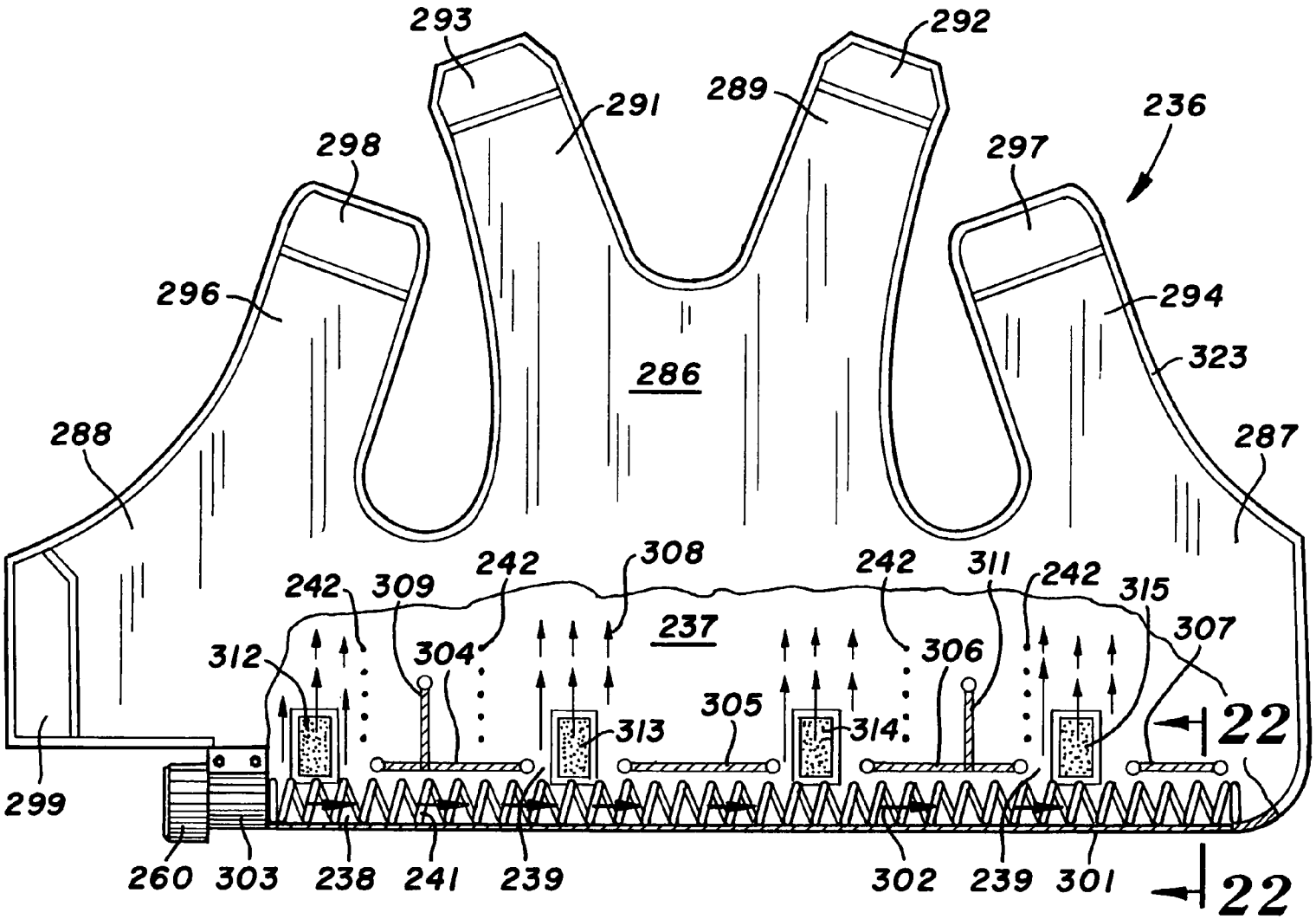
FIG. 20 is an enlarged inside front and rear plan view partly sectioned of the air bladder of the respiratory vest of FIG. 13.

Bladder 236 adapted to be located within vest 211, shown in FIG. 18, 19, and 20, has a back section 286 joined to front panel sections 287 and 288 surrounding internal air chamber 237. Upwardly directed shoulder sections 289 and 291 are joined to back section 286. The upper ends of sections 289 and 291 have flat ends 292 and 293. Panel sections 287 and 288 have upwardly directed front sections 294 and 296 having flat ends 287 and 298. A flat end 299 is on the outer end of panel section 288. Ends 292, 293, 297, 298 and 299 are supports used to secure bladder 236 inside of vest 211 to hold bladder 236 within shoulder straps 243 and 244, front straps 281 and 282, and front panels 245 and 247.

Figure 23:
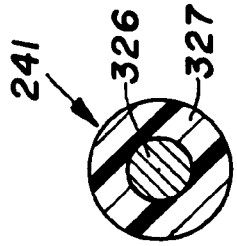
FIG. 23 is an enlarges sectional view taken along line 23-23 of FIG. 22.
Figure 22:
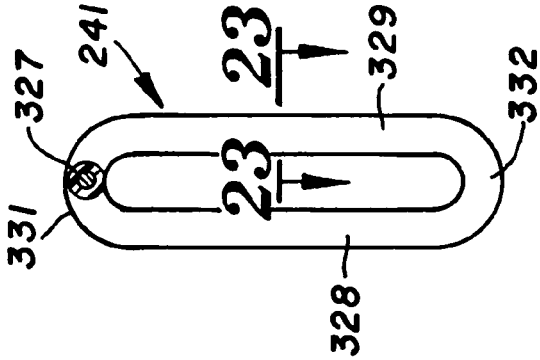
FIG. 22 is an enlarged sectional view taken along line 22-22 of FIG. 20.
Figure 21:
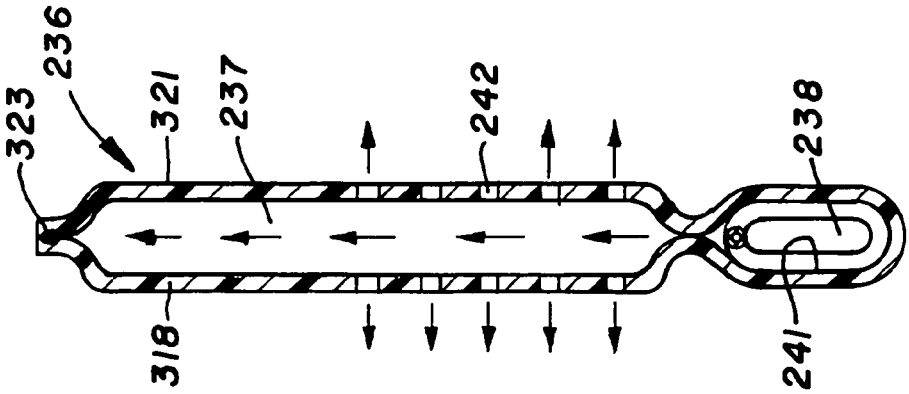
FIG. 21 is an enlarged sectional view taken along the line 21-21 of FIG. 19.

As shown in FIG. 20, an oval-shaped coil spring 241 extended along the bottom of bladder 236 located in a sleeve 301 surrounds an air receiving passage 238. Spring 241 is a flexible oval-shaped coil spring that allows the vest to be placed about the body of a person. As shown in FIGS. 22 and 23, spring 241 has an oval-shaped metal wire 326 enclosed within a soft flexible and elastic plastic cover 327. Wire 326 maintains the oval shape of spring 241. As seen in FIG. 22, spring 241 has linear sides sections 328 and 329 joined to convex ends 331 and 332. The elastic cover 327 and linear side sections 328 and 329 of spring 241 distribute forces subjected to spring 241 to relatively wide and elongated access thereby reducing concentrated forces on the thorax. The elastic cover 327 and convex ends 331 and 332 eliminate sharp edges. Coil spring 241 maintains the lower portion or sleeve 301 of bladder 236 in a tubular oval shape to ensure the flow of air in passage 238. Passage 238 extends between tube connector 260 and the opposite end of air core 236 to carry air and air pressure pulses, shown by arrows 302, along the length of passage 238. A tubular clamp 303 secures the air inlet end of spring 241 and tubular connector 260 to air core 236. A plurality of horizontal seals 304, 305, 306 and 307 in bladder 236 extend along the top of spring 241. Adjacent seals are spaced from each other to provide passages 239 to allow air and air pressure pulses to flow upwardly into air chamber 237. The air pulses, shown by arrows 308, are also directed upwardly into air chamber 237. The air pulses direct inwardly and upwardly directed pressure forces to the thorax of person 213 to enhance airway clearance of secretions. Rows of air flow control apertures 242 in bladder 236 extend upwardly from seals 304-307. Upright linear seals 309 and 311 separate the rows of apertures 242 extended upwardly from seals 304 and 306. As shown in FIG. 21, apertures 242 are small holes that allow air to escape from air chamber 237 and deflate air core 236. The rows of apertures 242 located between back section 286 and front sections 287 and 288 allow air to flow into vest 211 adjacent the opposite sides of the thorax of person 213. The flowing air also cools the sides of the thorax surrounded by vest 211.

Figure 24:
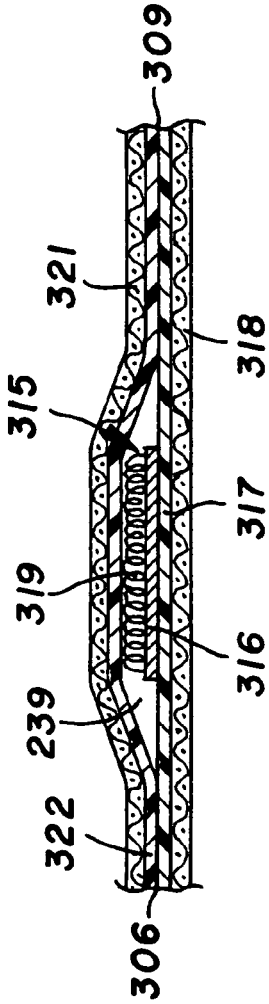
FIG. 24 is an enlarged sectional view taken along line 24-24 of FIG. 19.

As shown in FIG. 12, a spacer pad 312 is located adjacent the outer end of seal 304. Additional spacer pads 313, 314 and 315 are located between seals 304 and 305, 305 and 306, and 306 and 307. Spacer pads 312-315 maintain passages 239 open to ensure air flow and air pressure pulses from passage 238 into air chamber 237 of bladder 236. Spacer pads 312-314 are rectangular loop pads secured with an adhesive to the inside wall of bladder 236 between seals 104-107. As shown in FIG. 24, spacer pad 315 has a base 316 secured with an adhesive to the inside layer 317 of the first side wall 318 of air core 236. Loops 319 attached to base 316 project outwardly toward a second side wall 321 to space the inside layer 322 of side wall 321 providing passages 239 to allow air to flow from passage 238 into air chamber 237 of bladder 236. Air also flows through loops 319 from passage 238 into air chamber 237. Side walls 318 and 321 are flexible sheets of plastic or fabric. The inside layers 317 and 322 are urethane plastic bonded to the inside of side walls 318 and 321. Layers 317 and 322 are air impervious except for the rows of apertures 242, shown in FIGS. 19 and 20. The plastic of layers 317 and 322 are fused together along the length of seals 304-307. As shown in FIGS. 18 to 21, the adjacent outer peripheral edges of side walls 318 and 321 are fused together to prevent leakage of air from the peripheral edges of bladder 236. Side walls 318 and 319 can be sheets of urethane plastic or other sheet materials.

Figure 26:
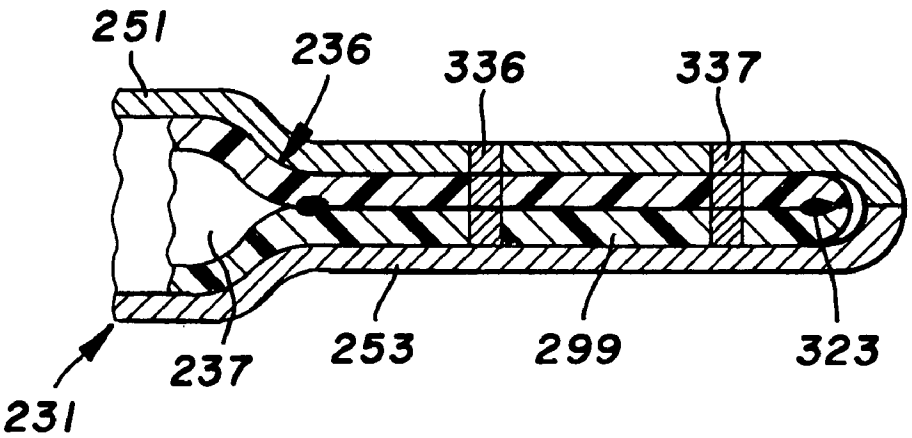
FIG. 26 is an enlarged sectional view taken along line 26-26 of FIG. 16.
Figure 25:
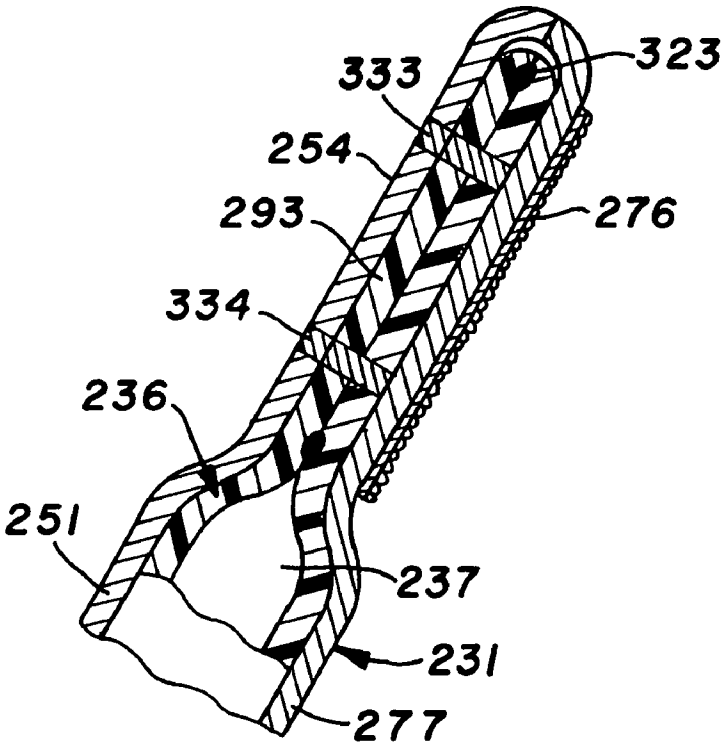
FIG. 25 is an enlarged sectional view taken along the line 25-25 of FIG. 16.

As shown in FIGS. 25 and 26, bladder 236 is permanently secured to vest cover 231 for use as a single patient vest. End section 293 of air bladder 236 is located in the outer end of shoulder section 254. Heat seals or sonic welds 333 and 334 bond shoulder section 254 to bladder end section 293. End sections 292, 297 and 298 of bladder 236 are also bonded with heat seals or sonic welds to cover 231 as illustrated in FIG. 25. As shown in FIG. 26, front section 253 of cover 231 is located around bladder end 299. Heat seals or sonic welds 336 and 337 bond bladder end 299 to front section 253 of cover 231.

In use, vest 211 is placed about the person's body 214, as shown in FIGS. 13 and 14, and held in place with shoulder straps 254 and 256. Releasable fasteners 248, 274 and 249, 276 secure straps 254 and 256 to front panels 247 and 273. The circumferential location of vest 211 is maintained in a snug fit around the person's body 214 with releasable fasteners 258 and 259. Retainer 278 maintains fasteners 258 and 259 in engagement with each other and prevents disengagement during the pulsating of vest 211. Air pulsator 212 is then connected with hose 261 to collar 260. The operation of air pulsator 212 is started by turning switch 267 ON. The air flows from hose 261 into air passage 238 of sleeve 301 and openings 239 upwardly into air chamber 237 of bladder 236. The pulsing of air in chamber 237 applies repetitive pressure pulses to the person's body. The operation of air pulsator 212 is described in U.S. Pat. No. 6,254,556 and U.S. patent application Ser. No. 60/218,128, now U.S. Pat. No. 6,547,749. The air pulsator of U.S. Pat. No. 6,254,556 is incorporated herein by reference. Other types of air pressure and air pulse generators can be used to provide air pressure and air pressure pulses to vest 211. Examples of air pressure and air pulse generators are disclosed in U.S. Pat. Nos. 1,898,652; 2,588,192; 2,918,917; 3,078,842; 4,842,263; 5,569,170 and 6,036,662.

The invention claimed is:

1. A vest for applying repetitive pressure pulses to a human body comprising: a non-elastic outer cover, a flexible liner attached to the cover surrounding an internal chamber, a bladder located in the internal chamber between the cover and liner adapted to accommodate air pressure pulses which apply pressure pulses to a human body wearing the vest, said bladder having flexible side walls secured together providing an air chamber for accommodating air, said side walls having bottom portions, an elongated sleeve joined to the bottom portions of the side walls having an air receiving passage, said bottom portions having at least one passage open to said air chamber and air receiving passage to allow air and air pressure pulses to flow from the air receiving passage into said air chamber, and an elongated oval-shaped coil spring located within and along the length of the air receiving passage of said sleeve to maintain the air receiving passage open to allow air to flow in said air receiving passage.

2. The vest of claim 1 wherein: said bottom portions of the side walls have a plurality of spaced seals joining the side walls, the spaces between the seals being open to provide air flow passages open to said air chamber and air receiving passage to allow air and air pressure pulses to flow upwardly from the air receiving passage into said air chamber.

3. The vest of claim 2 including: spacer members secured to a side wall extended through said spaces between the seals to maintain said air flow passages open.

4. The vest of claim 3 wherein: said spacer members comprise loop pads secured to a side wall.

5. The vest of claim 1 wherein: said coil spring includes an oval-shaped wire and an elastic plastic coat covering said wire.

6. The vest of claim 1 including: apertures in said side walls to allow air to flow from the air chamber into the internal chamber between the cover and liner.

7. The vest of claim 6 including: an upright seal securing the side walls together located adjacent said apertures.

8. The vest of claim 1 including: upright rows of apertures in the side walls to allow air to flow from the air chamber into the internal chamber between the cover and the liner.

9. The vest of claim 8 including: upright seals securing the side walls together located between the upright rows of apertures.

10. The vest of claim 1 wherein: said bottom portions of the side walls have a plurality of horizontal spaced first seals and upright second seals joined to the first seals joining the side walls, the space between the first seals being open to provide air flow passages open to said air chamber and air receiving passage to allow air to flow upwardly from the air receiving passage into said air chamber, and apertures in said side walls adjacent said upright seals to allow air to flow out of the air chamber.

11. The vest of claim 10 including: spacer members secured to a side wall extended through said spaces between the seals to maintain said air flow passages open.

12. The vest of claim 11 wherein: said spacer members comprise loop pads secured to a side wall.

13. The vest of claim 1 including: fasterners permanently connecting the bladder to the cover.

14. The vest of claim 13 wherein: said fasteners permanently connecting the bladder to the cover includes seals joining portions of the bladder to the cover.

15. A vest for applying repetitive pressure pulses to a human body comprising: a cover having an internal chamber and first and second end sections, a bladder located within the internal air chamber adapted to accommodate air pressure pulses which apply pressure pulses to a human body wearing the vest, fasteners permanently connecting the bladder to the cover, said bladder having flexible side walls secured together providing an air chamber for accommodating air, said side walls having bottom portions, an elongated sleeve joined to the bottom portions of the side walls having an air receiving passage, said bottom portions having at least one passage open to said air chamber and air receiving passage to allow air and air pressure pulses to flow from the air receiving passage into said air chamber, an elongated open flexible spring member located in said air receiving passage of the sleeve to allow air to flow in the air receiving passage, said cover having a pair of shoulder straps and chest portions, first releasable members connecting the shoulder straps to the chest portions, said first and second end sections of the cover being located in overlapping relation when the cover and bladder are located around the body of the person, second releasable members connecting the first and second end sections to hold the bladder and cover around the body of the person whereby when the bladder is subjected to air pressure pulses repetitive pressure pulses are transmitted to the body of the person.

16. The vest of claim 15 wherein: said bottom portions of the side walls have a plurality of spaced seals joining the side walls, the spaces between the seals being open to provide air flow passages open to said air chamber and air receiving passage into said air chamber of the bladder.

17. The vest of claim 16 including: spacer members secured to a side wall extended through said spaces between the seals to maintain said air flow passages open.

18. The vest of claim 17 wherein: said spacer members comprise loop pads secured to a side wall.

19. The vest of claim 15 wherein: said spring member located within the air receiving passage of said sleeve is a flexible coil spring extended along the length of the air receiving passage of the sleeve.

20. The vest of claim 15 including: apertures in said side walls of the bladder to allow air to flow from the air chamber of the bladder into the internal chamber between the cover and bladder.

21. The vest of claim 20 including: an upright seal securing the side walls together located adjacent said apertures.

22. The vest of claim 15 wherein: the spring member located in said air receiving passage of the sleeve comprises an elongated oval-shaped coil spring located within and along the length of the air receiving passage of the sleeve.

23. The vest of claim 22 wherein: the coil spring includes an oval-shaped wire and an elastic plastic coat covering said wire.

24. The vest of claim 15 including: upright rows of apertures in the side walls to allow air to flow from the air chamber into the internal chamber between the cover and the bladder.

25. The vest of claim 24 including: upright seals securing the side walls together located between the upright rows of apertures.

26. The vest of claim 15 wherein: said bottom portions of the side walls have a plurality of horizontal spaced first seals and upright second seals joined to the first seals joining the side walls, the space between the first seals being open to provide air flow passages open to said air chamber and air receiving passage to allow air to flow upwardly from the air receiving passage into said air chamber, and apertures in said side walls adjacent said upright seals to allow air to flow out of the air chamber.

27. The vest of claim 26 including: spacer members secured to a side wall extended through said spaces between the seals to maintain said air flow passages open.

28. The vest of claim 27 wherein: said spacer members comprise loop pads secured to a side wall.

29. A vest for applying repetitive pressure pulses to a human thorax comprising: a cover having an internal chamber adapted to surround a human thorax, a bladder having an air chamber located within the internal chamber of the cover, fasteners permanently connecting the bladder to the cover to retain the bladder within the internal chamber of the cover, said bladder having flexible side walls secured together providing at least one air chamber for accommodating air, said side walls having bottom portions, an elongated sleeve joined to the bottom portions having an air receiving passage and at least one passage open to said air chamber and air receiving passage to allow air and air pressure pulses to flow from the air receiving passage into said air chamber, and an elongated flexible coil spring located within and along the length of the air receiving passage of said sleeve to maintain the air receiving passage open to allow air to flow in said air receiving passage and from the air receiving passages into the air chamber of the bladder.

30. The vest of claim 29 wherein: said bottom portions of the side walls have a plurality of spaced seals joining the side walls, the spaces between the seals being open to provide air flow passages open to said air chamber and air receiving passage to allow air and air pressure pulses to flow upwardly from the air receiving passage into said air chamber.

31. The vest of claim 30 including: spacer members secured to a side wall extended through said spaces between the seals to maintain said air flow passages open.

32. The vest of claim 31 wherein: said spacer members comprise loop pads secured to a side wall.

33. The vest of claim 29 wherein: said coil spring within the air receiving passage of said sleeve is a flexible oval-shaped coil spring extended along the length of the air receiving passage.

34. The vest of claim 29 including: apertures in said side walls of the bladder to allow air to flow out of the air chamber of the bladder.

35. The vest of claim 34 including: an upright seal securing the side walls together located adjacent said apertures.

36. The vest of claim 29 wherein: said bottom portions of the side walls have a plurality of horizontal spaced first seals and upright second seals joined to the first seals join the side walls, the space between the first seals being open to provide air flow passages open to said air chamber and air receiving passage to allow air to flow upwardly from the air receiving passage into said air chamber, and apertures in said side walls adjacent said upright seals to allow air to flow out of the air chamber.

37. The vest of claim 36 including: spacer members secured to a side wall extended through said spaces between the seals to maintain said air flow passages open.

* * * * *